United States Patent [19]

Bertoglio

[11] 4,439,042

[45] Mar. 27, 1984

[54] APPARATUS TO CONTINUOUSLY MIX AND HOMOGENIZE POWDERED SUBSTANCES WITH LIQUID SUBSTANCES

[75] Inventor: Guido Bertoglio, Viganello, Switzerland

[73] Assignee: Water-Line S.A., Mezzovico, Switzerland

[21] Appl. No.: 436,451

[22] Filed: Oct. 25, 1982

[30] Foreign Application Priority Data

Oct. 23, 1981 [CH] Switzerland ..... 6829/81

[51] Int. Cl.[3] ..... B01F 7/10

[52] U.S. Cl. ..... 366/154; 366/157; 366/176; 366/178; 366/303; 366/317

[58] Field of Search ..... 209/365 R; 366/32, 154, 366/155, 156, 157, 165, 167, 168, 171, 176, 177, 178, 181, 183, 263, 264, 303, 304, 306, 315, 317; 403/307, 342, 349

[56] References Cited

U.S. PATENT DOCUMENTS

| | | | |
|---|---|---|---|
| 3,954,604 | 5/1976 | Krause et al. | 209/365 R |
| 4,026,817 | 5/1977 | Ciuti et al. | 366/176 |
| 4,068,831 | 1/1978 | Ebeling et al. | 366/156 |
| 4,148,100 | 4/1979 | Moller | 366/168 |
| 4,277,197 | 7/1981 | Bingham | 403/342 |

FOREIGN PATENT DOCUMENTS

| | | | |
|---|---|---|---|
| 242040 | 8/1965 | Austria | 366/158 |
| 1239319 | 7/1971 | United Kingdom . | |
| 1388889 | 3/1975 | United Kingdom | 366/303 |

*Primary Examiner*—Robert W. Jenkins
*Assistant Examiner*—Arthur D. Dahlberg
*Attorney, Agent, or Firm*—Young & Thompson

[57] ABSTRACT

Apparatus for the continuous mixing and homogenization of powdered substances, such as powdered milk, with water or other beverages, comprises a hopper (1) with vibrating sieve (2) and a screw (3) situated at the base of the hopper and actuated with variable angular velocity by a motor (4). The powdered substance is transported by the screw to a nozzle (5) opening into a converging-diverging chamber (6) which functions as Venturi tube. The liquid enters from an injection conduit (7) and is mixed with the powder and the mixture is carried to a homogenization turbine (9, 10) from which it is discharged completely homogenized.

6 Claims, 3 Drawing Figures

APPARATUS TO CONTINUOUSLY MIX AND HOMOGENIZE POWDERED SUBSTANCES WITH LIQUID SUBSTANCES

The difficulty of continuously mixing powdered substances with liquid substances in the proper liquid-powder proportions while avoiding the formation of lumps has been noted.

This difficulty is particularly present when for example a perfectly homogenous mixture of powdered milk with water or other beverages is desired.

The object of the present invention is an apparatus which resolves the problem in a truly satisfactory manner.

Existing apparatuses do not satisfactorily fulfill the existing requirements.

The attached drawing clearly shows diagrammatically a preferred but nonlimiting embodiment of the apparatus.

Figure 1:
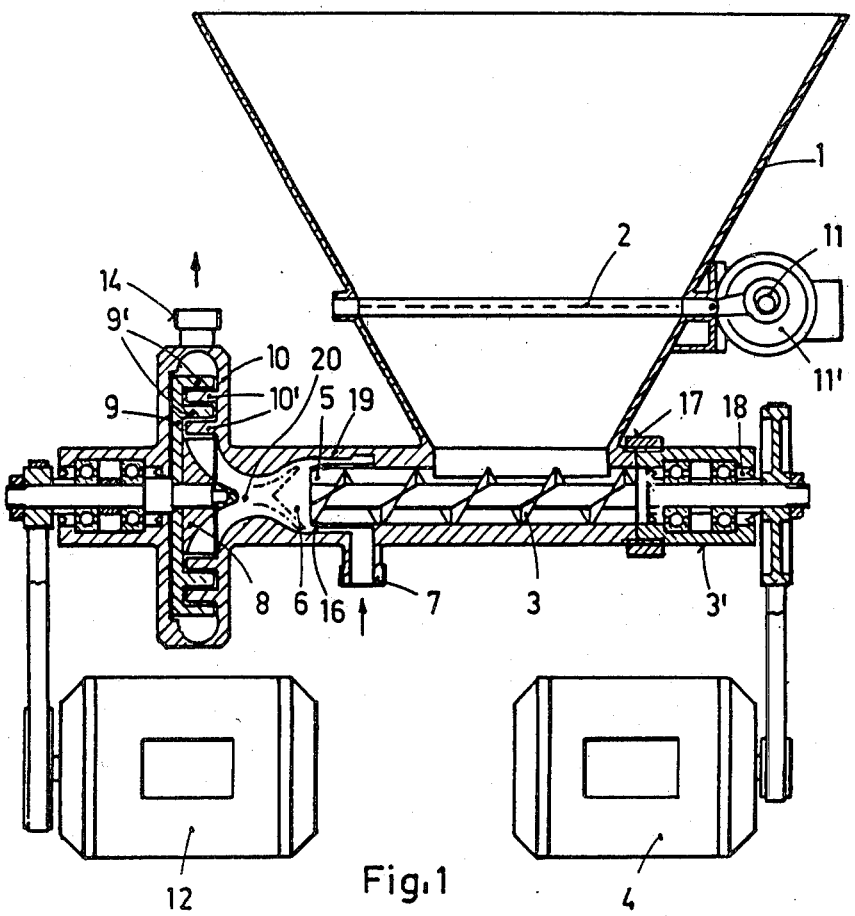
FIG. 1 shows an axial cross section.

In FIG. 1, the apparatus comprises the hopper 1 which contains the powdered substance. The vibrating sieve 2 is arranged in it, and is actuated by the eccentric 11, preferably controlled by its own motor (11') or by another motion element.

The purpose of this sieve is to hold back the extraneous substances which sometimes accompany the powdered substance (pieces of string, lumps or the like).

At the base of hopper 1 is found the screw 3 which turns inside a housing which terminates with a restriction or narrowed part 5 which services to slightly compress the powder in such a manner that it is held back when the screw is stopped. The screw is supported on support 3' provided with bearings and with a gasket 18 which prevents the powder from entering into the bearings themselves. A variable speed motor 4 actuates screw 3. The angular speed must be adapted by introduction of the desired quantity of powder, proportioned to the volume of liquid fed into the screw, and the liquid must enter at constant pressure and velocity, controlled by a flowmeter.

Variable speed motor 4 can be replaced by a torque or belt convertor.

Support 3' with the bearings and screw 3 form one unit which is easily dismountable by a bayonette attachment of threaded ring nut 17, so as to facilitate the cleaning of the screw itself and the housing.

Screw 3 transports the powdered material to the exit constriction 5 which opens into a converging-diverging chamber 6 functioning as a Venturi tube. The liquid to be mixed arrives in said chamber from conduit 7. Said liquid is required to pass through the annular nozzle 16 formed by the housing which encloses the screw and the external wall 19.

Figure 2:
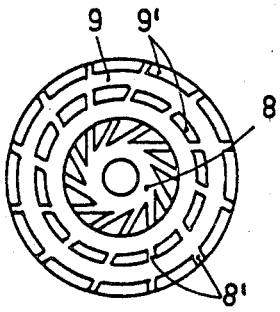
FIG. 2 shows the rotor of the turbine.
Figure 3:
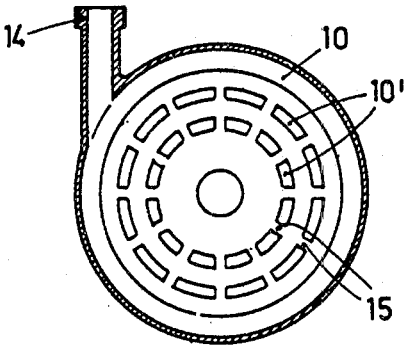
FIG. 3 shows the diffuser.

The liquid is discharged at great velocity in the shape of a circle, is shot into chamber 6, to then expand, then is sucked out again by turbine 9, 10, which pushes it by centrifugal force, mixed with the powder, through channels 8' and 15 (FIGS. 2 and 3). The inclined channels and the rapidly rotating rotor aid in forcing the mixture through channels 15 of the stationary diffuser, which functions as a pump. The mixture is perfectly homogenized by passage through revolving channels 8' and stationary channels 15. Stationary channels 15 can be radial or inclined in the opposite direction from channels 8' of the rotor.

The liquid which is discharged from the nozzle at great velocity follows the external wall of housing 19, then is held back in the constriction 20. An empty space 6 is formed around the screw discharge, which catches the powder pushed continuously by the screw. Thus the liquid never enters into contact with the screw itself, and if this would happen, the powder would coagulate and in a short time the screw would be stuck.

The device works in the following manner: first the turbine 9, 10 is started, and when the same has reached maximum speed, a valve placed below the turbine (valve not shown) is opened, thus creating a certain space, then screw 3 is started, and simultaneously a valve for the liquid above (also not shown) is opened, situated to correspond with joint 7.

Thus is initiated the process of mixing and homogenization which can continue without end, until the desired degree of mixing is obtained.

To stop the process, first the screw is stopped, and immediately the valve of the liquid situated above is closed. After some seconds, when all the mixture is discharged from chamber 20 and from turbine 9, 10, the valve below is closed and the turbine is stopped. To avoid errors, the starting and stopping sequences are executed automatically.

The apparatus which is disclosed is suited to continuously mix for example powdered milk with water in any quantity in a satisfactory manner. Presently this mixing is done in containers. with a certain water content, to which the powdered milk is added and which is mixed by means of a stirrer. To obtain great quantities, very large receptacles with costly installations are used. The disclosed apparatus, which can be attached directly to the bottling or packaging machine for nonreturn packaging, requires only a minimum investment.

It is obvious that the apparatus as disclosed can be adopted for mixing any liquid with any powder.

What is claimed is:

1. Apparatus for the continuous mixing and homogenization of powdered substances with liquid substances, comprising a hopper (1) adapted to contain the powdered substance; a screw (3) situated at the base of the hopper, a housing surrounding said screw said housing having a terminal construction followed by a converging-diverging chamber functioning as a venturi, a motor (4), for actuating the screw such that the powdered substance is transported to a said terminal constriction (5) to hold back the powder flowing into said converging-diverging chamber (6); an injector conduit, an annular nozzle (16) from which liquid, introduced under pressure from said injection conduit (7) is discharged at great velocity in an annular stream into said venturi; a homogenization turbine, comprising a rotor with a plurality of rings (9') having channelling (8') to which rotor the powdered mixture plus liquid is fed from said venturi, and a stationary diffuser (10) having rings (10') interfingering with those of the rotor and having channelling (15); said rotor terminating in a discharge conduit (14) for the homogenized mixture.

2. Apparatus as claimed in claim 1, and a vibrating sieve disposed in the hopper to sieve the powdered substance.

3. Apparatus as in claim 2, in which said vibrating sieve is actuated by means of an eccentric (11) controlled by its own independent motor (11'); the screw (3) is actuated by an adjustable speed motor (4), and the homogenization turbine (9-10) is also actuated by its own independent motor (12).

4. Apparatus as in claim 1, in which the space between the rings (9') of the rotor and those of the diffuser (10') is on the order of a few hundredths of a millimeter, to obtain a high degree of homogenization.

5. Apparatus as in claim 1, in which the group comprising the screw (3) and its support with bearings (31) is easily dismountable and remountable by means of a bayonette attachment (17) or threaded ring nut, to facilitate cleaning.

6. Apparatus as claimed in claim 1, in which said terminal constriction comprises the radially inner wall of said annular nozzle, and the outer wall of said annular nozzle merges directly into a converging wall of said venturi.

* * * * *